United States Patent [19]

Joice

[11] 4,068,566

[45] Jan. 17, 1978

[54] UNIVERSAL BAG-MAKING MACHINE

[76] Inventor: Richard L. Joice, 8955 Fullbright Ave., Chatsworth, Calif. 91311

[21] Appl. No.: 667,205

[22] Filed: Mar. 15, 1976

[51] Int. Cl.[2] ..... F15B 15/22

[52] U.S. Cl. ..... 93/8 R; 93/33 H

[58] Field of Search ..... 226/113, 114; 93/8 R, 93/33 H

[56] References Cited

U.S. PATENT DOCUMENTS

| | | | |
|---|---|---|---|
| 1,905,446 | 4/1933 | Dewey et al. | 226/113 |
| 3,470,795 | 10/1969 | Davis | 93/8 R |
| 3,531,035 | 9/1970 | Maynard et al. | 226/114 |
| 3,743,567 | 7/1973 | Abler | 93/8 R |

*Primary Examiner*—Gerald A. Dost
*Attorney, Agent, or Firm*—Allan M. Shapiro

[57] ABSTRACT

The web in the bag-making machine is continuously advanced from the web letoff to the takeup. At the operations station of the machine where operations take place on the web, the web is momentarily held stationary for operating thereon. A pair of swinging web control arms take up web at the entrance end of the station and let off web at the exit end during the moment at which the web is stationary. Operations take place when the web is stationary. Adjustments control length of time the web is stationary. Sealing and perforating operations are selectable.

21 Claims, 4 Drawing Figures

Fig. 3
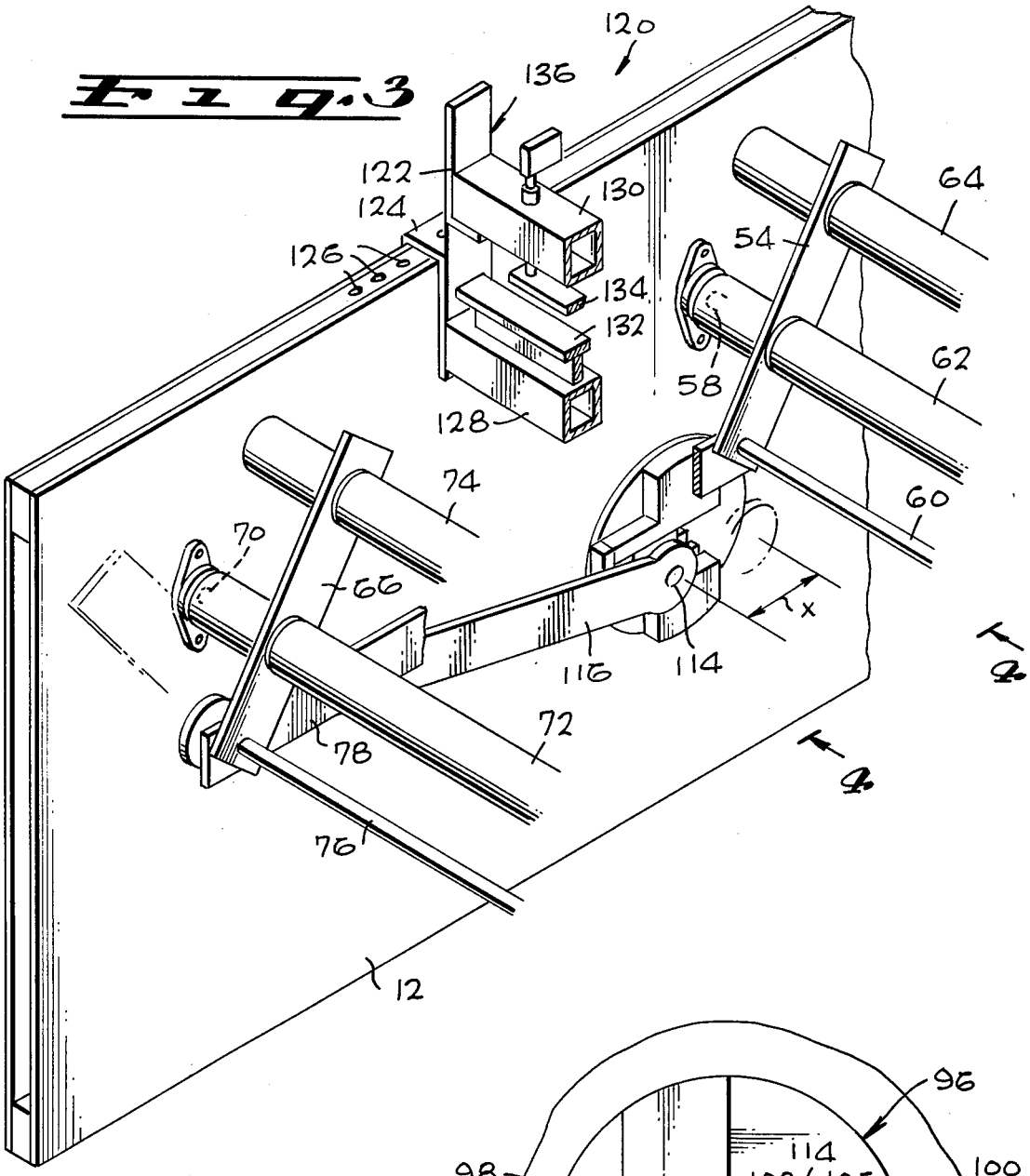
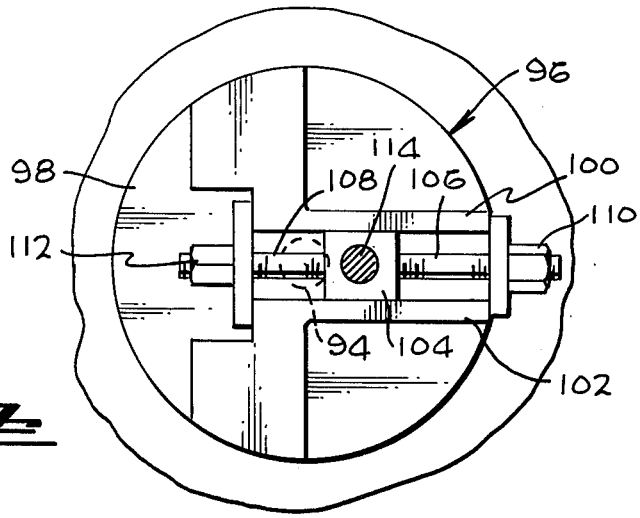
Fig. 4

UNIVERSAL BAG-MAKING MACHINE

BACKGROUND OF THE INVENTION

1. Field of the Invention

This invention is directed to a universal bag-making machine which has a web of bag material continuously moving therethrough and has an operations station at which the web is held or caused to be stationary for any selected bag making operation on the web.

2. Description of the Prior Art

Machinery is known for the making of bags out of tubes of synthetic polymer composition material, such as polyethylene and similar polymers. The material is either in flat form, which is folded and joined at the open edge, or is extruded as tubular material. Once tubular, all that is necessary is to join the sides of the tube at selected locations to close each bag bottom and to cut or perforate below the bottom to separate the bags from the continuous web. When the bags are to be wound, it is preferable to simply perforate and rely upon a subsequent step for separation of the bags.

The sealing and perforation step can be accomplished by flying equipment which moves with the web, but this is inconvenient because the operating equipment would then need to be designed to operate under accelerational loads. Furthermore, connections to such moving parts are more difficult. Thus, the flying equipment has been an unsatisfactory solution to the problem.

Furthermore, present bag-making equipment is designed so that each unit makes only one type and size of bag. There is no opportunity for bag size adjustments or changes in operations or bag type. Present equipment is efficient, but not flexible or universal.

SUMMARY OF THE INVENTION

In order to aid in the understanding of this invention, it can be stated in essentially summary form that it is directed to a universal bag-making machine wherein the web moving through the operations station of the machine is momentarily held or caused to be stationary for operating thereon.

It is thus an object of this invention to provide a universal bag-making machine which is capable of making various types of bags from synthetic polymer composition material by operating on tubes of such material. It is another object to provide a bag-making machine wherein the web passing through the operations station is momentarily held or caused to be stationary so that operations can be performed thereon by relatively simple tooling at the operations station, which tooling is not required to fly with the moving web in order to operate thereon. It is a further object to provide a bag-making machine wherein the length of time that the web is held stationary is adjustable so that different types of bags and different web line speeds can be accommodated by machine adjustment. It is another object to provide an operations station wherein different types of tooling can be applied for making different types of bags. It is a further object to provide a machine which can operate on different widths of web or simultaneously on plural side-by-side webs to provide a universal bag-making machine.

The features of the present invention which are believed to be novel are set forth with particularity in the appended claims. The present invention, both as to its organization and manner of operation, together with further objects and advantages thereof, may be understood best by reference to the following description taken in connection with the accompanying drawings.

BRIEF DESCRIPTION OF THE DRAWINGS

FIG. 3 is an enlarged isometric view, particularly showing the drive structure of the web control arms.

FIG. 4 is an enlarged view of the adjustable eccentric for controlling the web control arms, as seen along the line 4—4 of FIG. 3.

DESCRIPTION OF THE PREFERRED EMBODIMENT

Figure 1:
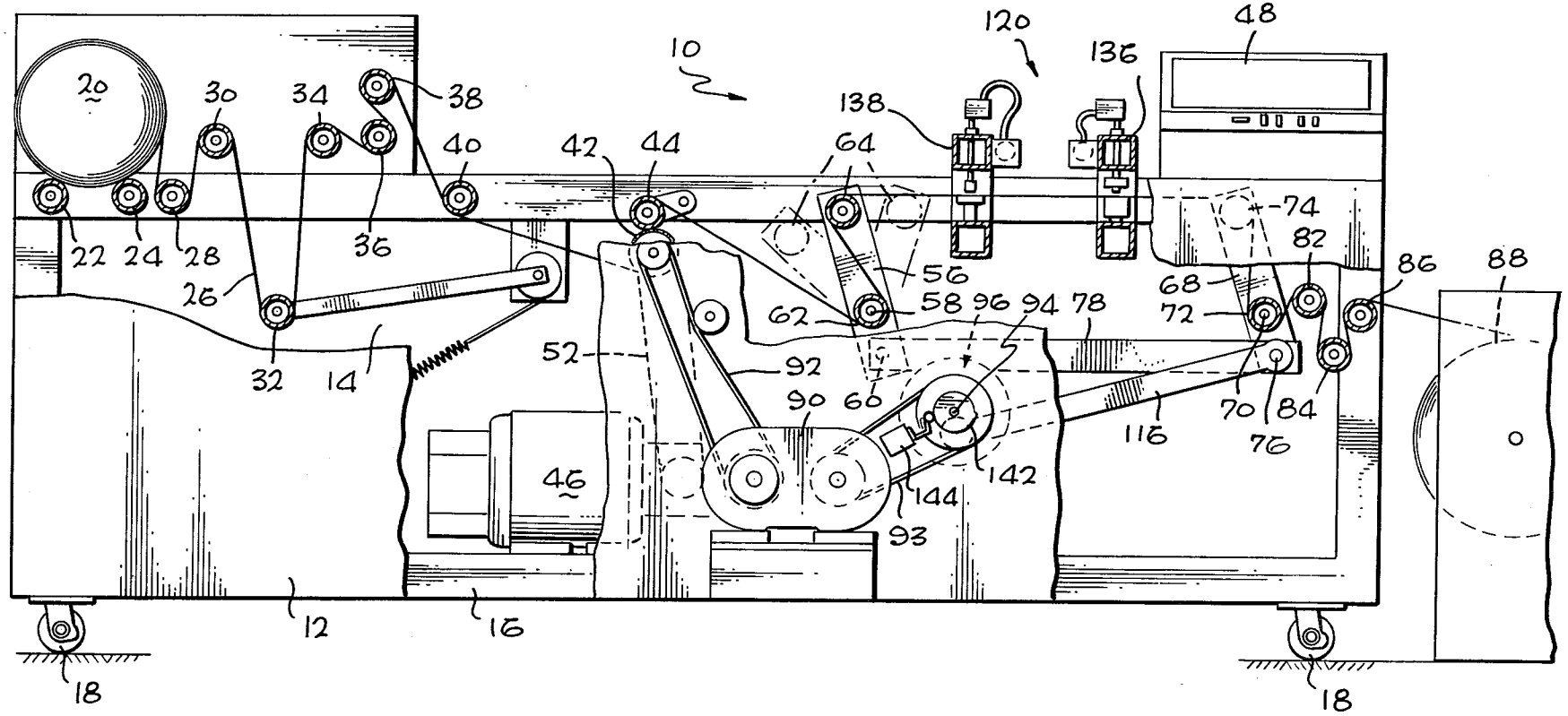
FIG. 1 is a side elevational view of the universal bag-making machine of this invention, with parts broken away and parts taken in section in order to aid in the viewing of parts of the internal structure thereof.
Figure 2:
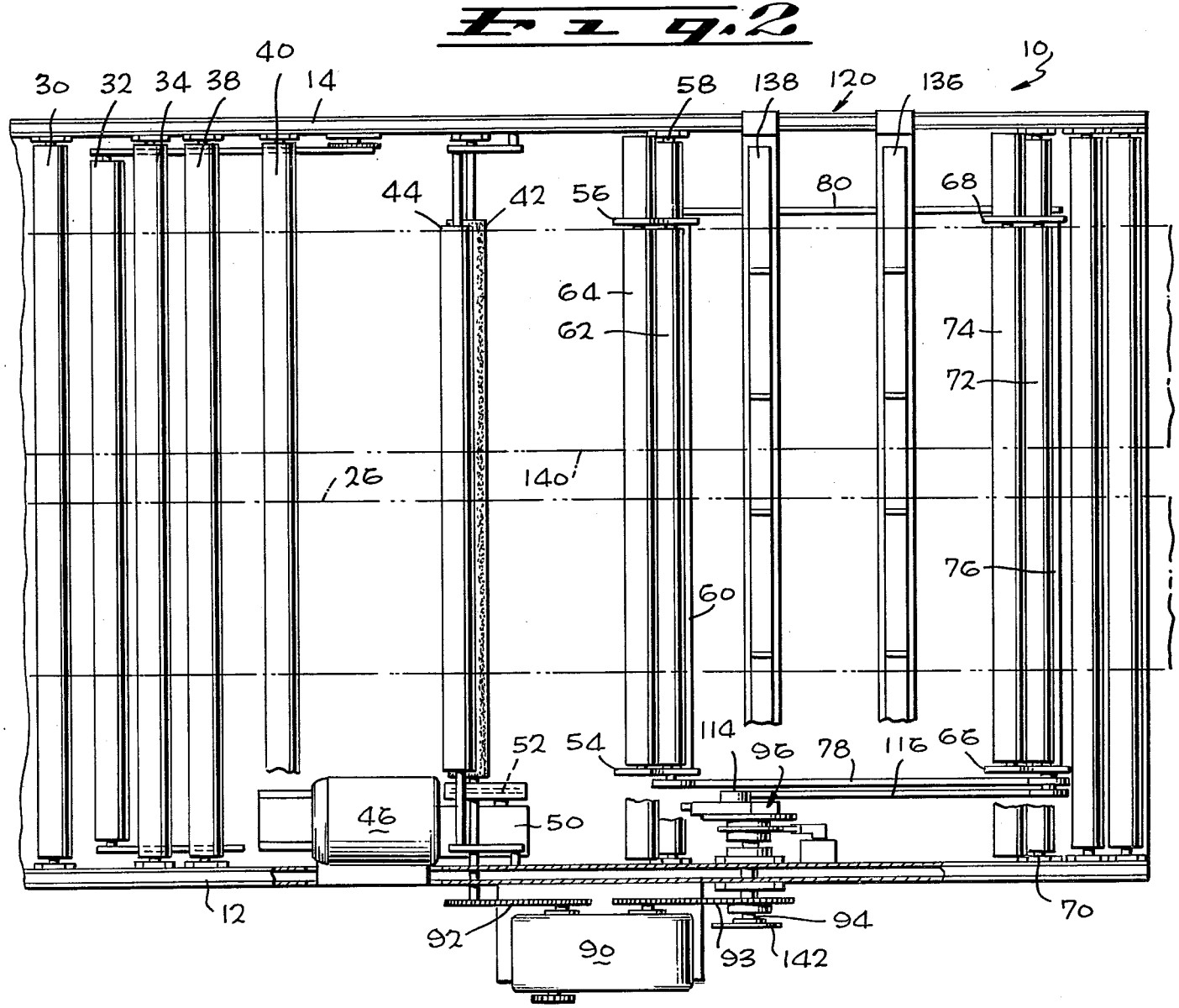
FIG. 2 is a plan view of the machine of FIG. 1, with other parts broken away and parts taken in section to better show the drive mechanism.

The universal bag-making machine of this invention is generally indicated at 10 in FIGS. 1 and 2. Machine 10 is a channel-shaped structure having near wall 12 and far wall 14 both upwardly extending from bottom 16. The machine may be mounted on rollers 18 to aid in its positioning. Most of the machine structure is located between the walls or is mounted on the walls, which serve as prime frame members of the machine.

Roll 20 is a roll of tubular thermoplastic synthetic polymer composition material, such as polyethylene. It may be extruded in tubular form or folded from flat sheet and with the edges thereof sealed. Roll 20 serves as the stock from which the bags will be made. Roll 20 is mounted on support rollers 22 and 24, which carry the weight of the roll. Web 26 is unwound from roll 20 and passes under and over guide rolls 28 and 30, respectively. Web 26 passes under dancer roller 32 and thence around guide rollers 34, 36, 38 and 40 to pass around drive roller 42 and over press roller 44.

Main drive motor 46, see FIGS. 1 and 2, is preferably a variable speed motor such as a DC motor with a suitable power supply for controlling its speed. Control cabinet 48 can house all of the control equipment and speed selectors. For example, press roller 44 can have a speed output signal to the control system, and the power supply to motor 46 is adjusted to maintain the rate of travel of web 26 at press roller 44 at a constant preselected rate. Motor 46 has geared speed reducer 50 connected to its shaft. Drive chain 52 interconnects sprockets on speed reducer 50 and on drive roller 42 so that drive roller 42 is positively driven by the motor. By means of this web-advancing equipment, web 26 is advanced at a predetermined, constant rate at drive roller 42. Thus, the web from roller 34 to roller 42 is also moving at that rate. The web is supplied at a fairly constant rate by powering one or more of the rollers 22, 24, 28 or 30 and by controlling the rate of rotation of those rollers from the position of dancer roller 32. When the dancer roller is high, unwinding should be faster; and when dancer roller 32 is low, unwinding should be slower. This is accomplished by conventional variable speed drives. The structure thus far described is fairly conventional in the supply of web at a constant speed. The web may have been subjected to prior processing such as edge sealing, printing, or other operations. Furthermore, it may be supplied at a substantially constant speed by other types of web-feeding means.

Web control arms 54 and 56 form a pair which are pivoted on axle 58 and are connected by tie bar 60.

Guide roller 62 is rotatably mounted on axle 58, and guide roller 64 is rotatably mounted at the upper ends of arms 54 and 56. These rollers on these web control arms form a web control arm structure which pivots on axle 58.

Similarly, web control arms 66 and 68 are pivotally mounted on axle 70. Guide rollers 72 and 74 are respectively rotatably mounted on axle 70 and on the upper end of the web control arms 66 and 68. Tie bar 76 connects arms 66 and 68 together so that they rotate together on axle 70. This structure forms a second web control arm structure. The two web control structures are connected together by links 78 and 80 so that they rock together on their respective axles 68 and 70.

As is seen in FIG. 1, web 26 extends from press roller 44 beneath roller 62, over rollers 64 and 74 and thence under roller 72. Then the web passes respectively over, under and over takeup guide rollers 82, 84 and 86 to takeup roll 88 which is preferably driven with constant web tension, as is known in the art.

Positive infinitely variable drive mechanism 90 has its input driven by chain 92 from drive roller 42. Drive mechanism 90 is such that it can be adjusted so that its output shaft rotates at a speed ratio with respect to its input which is selectable from an infinite number of variations within the speed ratio limits of the particular mechanism. Its output shaft is connected by chain 92 to drive control shaft 94.

The inner end of control shaft 94 carries adjustable eccentric mechanism 96, see FIG. 4. Disc 98 is fixed on the inner end of shaft 94 to rotate therewith. Guides 100 and 102 are fixed on the disc and carry nut 104 between them. Nut 104 is square and is guided by guides 100 and 102. Studs 106 and 108 have nuts 110 and 112, respectively, on their outer ends and secure nut 104 in a selected position. Nut 104 has a crankpin hole therein in which crankpin 114 is located. By adjusting the position of nut 104 between its guides, the amount of eccentricity of crankpin 114 with respect to control shaft 94 can be adjusted. Crank 116 is mounted on crankpin 114, and its other end is connected to tie bar 76. Thus, as the control shaft 94 rotates, the web control arm swings through arcs with the amount or length of arc controlled by the eccentricity of the crank. The crank imparts sinusoidal velocities to the control arms for convenient acceleration and deceleration. It is seen that, when the web is being fed and drive mechanism 90 is adjusted to rotate control shaft 94 once for each selected operation, the eccentricity of crankpin 114 can be selected so that the control arms swing the desired distance so that the web is stationary in the operation station between the control arms for a selected period of time in each cycle.

The operations station is generally indicated at 120 in FIGS. 1, 2 and 3. It is the location between the swinging control arms where operating equipment can be installed. Various types of tooling can be installed at the operations station. As a convenient structure, each of the sets of tooling at the operations station has an endplate 122, see FIG. 3, which has hook 124 engaged over the top of the side 12. A bolt through the hook engages in one of the screwholes 126 to hold the endplate in place. Lower crossbar 128 extends across the machine below the web, while upper crossbar 130 extends across the machine above the web and attaches to a similar endplate with hook on the other side of the machine. Anvil 132 is mounted on the lower crossbar and serves as a support for the web when tooling acts against the web. Upper crossbar 130 carries tool 134 which is movable up and down by electrically controlled fluid pressure equipment. When signaled, fluid pressure forces tool 134 down and later releases it. Tool 134 can be a perforator for making a series of almost connected slits across the web, or it can be a heat sealer. Any type of tooling can be employed, such as angle sealing for the shoulder sections of garment bags, perforating, notching, as well as the slitting and heat-sealing previously described. Tooling 136 is indicated in FIGS. 1, 2 and 3, and it is seen in FIGS. 1 and 2 that additional tooling 138 can also be applied to act on the web in the same or in a different manner at the same operations station.

Furthermore, it should be noted that two webs 126 and 140 are shown in FIG. 2. This illustrates that one or more webs can be acted upon at the same time. Each of the webs goes through the same stand of rollers and is acted upon in the same way by the rollers, including the holding of the web stationary at the operations station. The tooling can be arranged so that different tooling steps can be performed on the different webs, but the length along the webs between such acts must be the same or must be whole number multiples of length.

In setting up the machine, the main drive is set up so that the web will run at the desired constant speed. Then the ratio of the variable drive 90 is set up so that its output shaft makes one revolution as each bag length or integral-denominator fraction of bag length passes over drive roller 42. Each revolution of control shaft 94 corresponds to an operating cycle. The control arms swing through a portion of the cycle. The distance of arc they swing to the left (in the counterclockwise direction of FIG. 1) is adjusted by controlling the stroke of crankpin 114 (dimension X in FIG. 3) so that the web stops for a period of time in the operations station, during which period the tooling is caused to act by the controls in control cabinet 48.

Cam 142, see FIGS. 1 and 2, is mounted on control shaft 94. It operates switch 144 when the shaft is in the predetermined position. The switch and cam are adjusted so that this predetermined position corresponds to the period of time when the web is stationary at the operations station.

Switch 144 signals the controls in cabinet 48 to cause the operations to take place at that time. The operations are quickly completed and, as the control arms swing in the clockwise direction, the web is rapidly advanced through the operations station. In this way, without stopping the net motion of the web, the web is held or caused to be stationary for a sufficient length of time at the operations station for the necessary operations to take place thereon.

It will be noted that the stationary period or dwell time is the same for each of the plurality of parallel webs, of which webs 26 and 140 are exemplary. However, it is not necessary that the sealing, perforating or other work operations be performed on all of the webs at the same time, i.e., once per cycle. Thus, for example, the operations may be performed on web 26 during the dwell time of each cycle and on web 140 during the dwell time of every alternate cycle, or every third cycle, or every fourth cycle, to produce bags having respective lengths of two, three or four times that of bags produced from web 26.

It will be noted further that variations in the dwell time, ie., the period of time during which the web is caused to be stationary at the operations station, do not determine the length of the bag but, rather, control the portion of time of the cycle during which the operations are performed. This is because the bag length is determined by the relationship of the total cycle time to the web speed. Accordingly, in practice, the dwell time usually will be adjusted to be for as long a period of time as is possible, taking into consideration the dynamics of the web and the mechanical parts of the web control mechanism caused by changes in velocity. That is, for example, as the web speed is increased, the dwell time decreases proportionally and, further, the extent of travel of the control arms may have to be adjusted to be decreased which will reduce the dwell time even more. Conversely, if web speed is reduced, the extent of control arm travel can be increased, thus providing an even greater amount of time for operations which might most advantageously use the increased dwell time.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A bag-making machine comprising:

means for advancing a web of tubular synthetic polymer composition material from a source at a substantially constant rate;

first and second web control arms, each of said control arms being pivoted on its own separate pivot axis and spaced from each other in parallel with each other so as to pivot in the same direction with respect to the advancing web, each of said control arms carrying guide rollers thereon for guiding the web and for engaging the web for acting on the advancing web to cause the web to dwell at an operation station positioned between said first and second web control arms so that operation can be performed on the web at the operation station;

means positioned at said operation station for acting on said web, said means for acting on said web having power means thereon; and detecting means for detecting the position of said web control arms and connected to said power means for energizing said power means so that an operation is performed on the web when the web dwells at said operation station.

2. The bag-making machine of claim 1 wherein each of said first and second control arms is pivoted on a pivot axis so that said web control arms swing about said pivot axis and each of said web control arms carries one of said guide rollers rotatable on said pivot axis.

3. The bag-making machine of claim 2 wherein web control rollers are mounted on said first and second web control arms away from the axis thereof in engagement with the web and for carrying the web as said control arms swing on their axes.

4. The bag-magking machine of claim 3 wherein said first and second arms are connected together so that they both swing about their axes in the same direction at the same time.

5. The bag-making machine of claim 4 further including a crank and a connecting rod eccentrically pivoted on said crank, said connecting rod also being connected to one of said arms so that as said crank rotates said arms oscillate, said crank being mounted on a control shaft.

6. The bag-making machine of claim 5 wherein drive means is interconnected between said means for advancing the web and said control shaft for rotating said control shaft in relationship to the advance of the web so that as the web is advanced to a particular position said control arms swing to take up the advance of the web to cause the web to dwell at said operation station.

7. The bag-making machine of claim 6 wherein detecting means is connected for detecting the time at which the web so dwells.

8. The bag-making machine of claim 7 wherein said detecting means comprises a combination of a cam on said control sahft and a switch operated by said cam so that said switch is actuated when said control shaft and said web control arms are in a predetermined positional relationship.

9. The bag-making machine of claim 8 wherein said means for rotating said control shaft is adjustable for controlling the length of web advanced between operations.

10. The bag-making machine of claim 9 wherein the eccentricity of said crank is adjustable for adjusting the extent of swinging of said control rollers on said control arms so that the dwell time for the web in said operating station can be adjusted.

11. The bag-making machine of claim 10 wherein bag-making tooling is revovably mounted in the operations station of said bag-making machine.

12. A bag-making machine comprising:

means for advancing a web of tubular synthetic polymer composition material from a source at a substantially constant rate;

means comprising first and second web control arms engaging the web for acting on the advancing web, each of said first and second control arms being pivoted on a pivot axis so that each said web control arms swings about its own pivot axis, each of said control arms carrying a guide roller rotatable thereon on its pivot axis and carrying a guide roller thereon away from said pivot axis for guiding the web to cause the web to dwell between said first and second control arms; and an operation station positioned between said first and second control arms so that operations can be performed on the web during dwell of the web.

13. The bag-making machine of claim 12 wherein web control rollers are mounted on said first and second web control arms away from the axis thereof in engagement with the web and for carrying the web as said control arms swing on their axes.

14. The bag-making machine of claim 13 wherein said first and second arms are connected together so that they both swing about their axis in the same direction at the same time.

15. The bag-making machine of claim 14 further including a crank and a connecting rod eccentrically pivoted on said crank, said connecting rod also being connected to one of said arms so that as said crank rotates said arms oscillate, said crank being mounted on a control shaft.

16. The bag-making machine of claim 15 wherein drive means is interconnected between said means for advancing the web and said control shaft for rotating said control shaft in relationship to the advance of the web so that as the web is advanced to a particular position said control arms swing to take up the advance of the web to cause the web to dwell at said operation station.

17. The bag-making machine of claim 16 wherein detecting means is connected for detecting the time at which the web so dwells.

18. The bag-making machine of claim 17 wherein said detecting means comprises a combination of a cam on said control shaft and a switch operated by said cam so that said switch is actuated when said control shaft and said web control arms are in a predetermined positional relationship.

19. The bag-making machine of claim 18 wherein said means for rotating said control shaft is adjustable for controlling the length of web advanced between operations.

20. The bag-making machine of claim 19 wherein the eccentricity of said crank is adjustable for adjusting the extent of swinging of said control rollers on said control arms so that the dwell time for the web in said operating station can be adjusted.

21. The bag-making machine of claim 20 wherein bag-making tooling is removably mounted in the operations station of said bag-making machine.

* * * * *